United States Patent [19]

Marsh

[11] 4,232,532

[45] Nov. 11, 1980

[54] APPARATUS FOR CONTROLLING THE TEMPERATURE OF A BOTTLE

[76] Inventor: Lawrence B. Marsh, 12842 Littleton St., Silver Spring, Md. 20906

[21] Appl. No.: 52,468

[22] Filed: Jun. 27, 1979

[51] Int. Cl.[3] ..... F25D 3/08

[52] U.S. Cl. ..... 62/457; 62/383; 220/412

[58] Field of Search ..... 62/371, 457, 45, 514 R, 62/383; 126/261, 262, 263; 220/412

[56] References Cited

U.S. PATENT DOCUMENTS

| | | | |
|---|---|---|---|
| 564,657 | 7/1896 | Stiebel, Jr. | 126/261 |
| 2,169,387 | 8/1939 | Hann | 62/383 |
| 3,302,428 | 2/1967 | Stoner et al. | 62/457 |
| 3,703,816 | 11/1972 | Weathers | 62/457 |
| 3,807,194 | 4/1974 | Bond | 62/457 |
| 3,995,445 | 12/1976 | Huskins | 62/457 |
| 4,163,374 | 8/1979 | Moore et al. | 62/457 |

FOREIGN PATENT DOCUMENTS

| | | | |
|---|---|---|---|
| 471617 | 2/1951 | Canada | 126/263 |

*Primary Examiner*—Ronald C. Capossela
*Attorney, Agent, or Firm*—Lawrence E. Laubscher

[57] ABSTRACT

A device for controlling the temperature of a bottle, jar or the like is disclosed, characterized in that the desired temperature of the bottle may be selected and maintained by mechanically adjusting the heat transfer surface area of the device. The device includes inner and outer containers arranged in concentrically spaced relation, each of the containers having a vertically arranged tubular wall portion open at its upper end. The inner container is formed from a heat conducting material, and a first fluid medium having a given initial temperature is arranged in the space between the inner and outer containers. The bottle is arranged within the inner container as is a heat energy transfer control device which controls the transfer of heat energy between the bottle and the first fluid medium through the inner container, thereby to control the temperature of the bottle.

9 Claims, 4 Drawing Figures

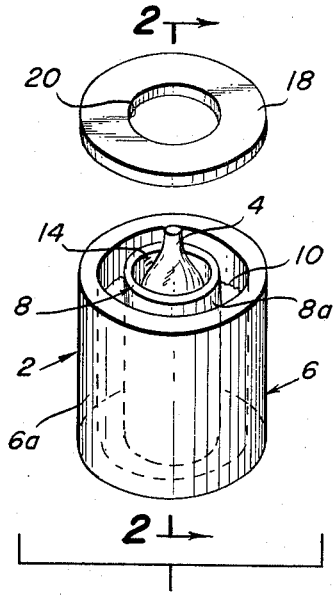
Fig. 1
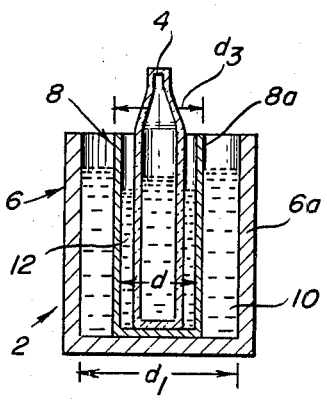
Fig. 2
Fig. 3
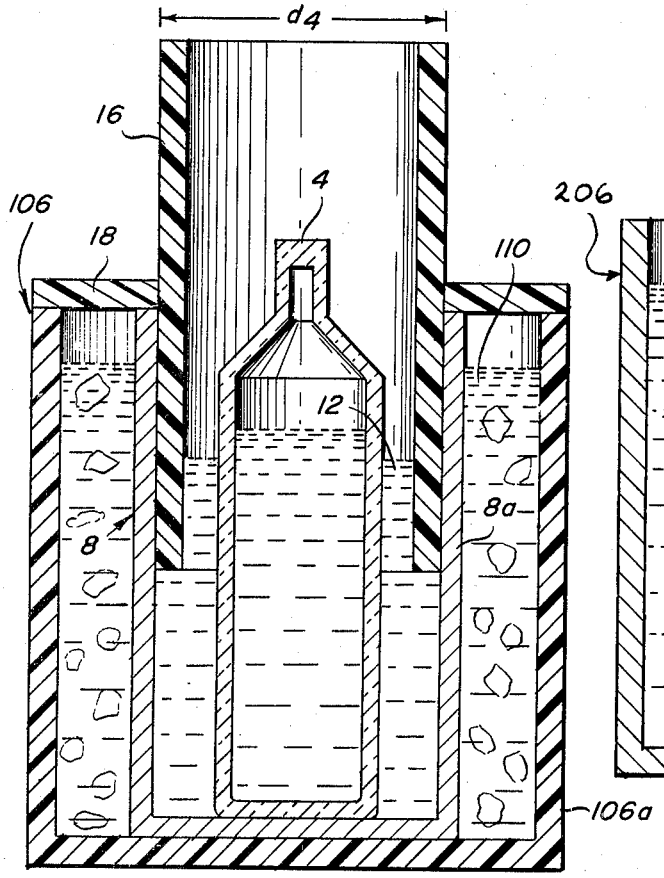
Fig. 4
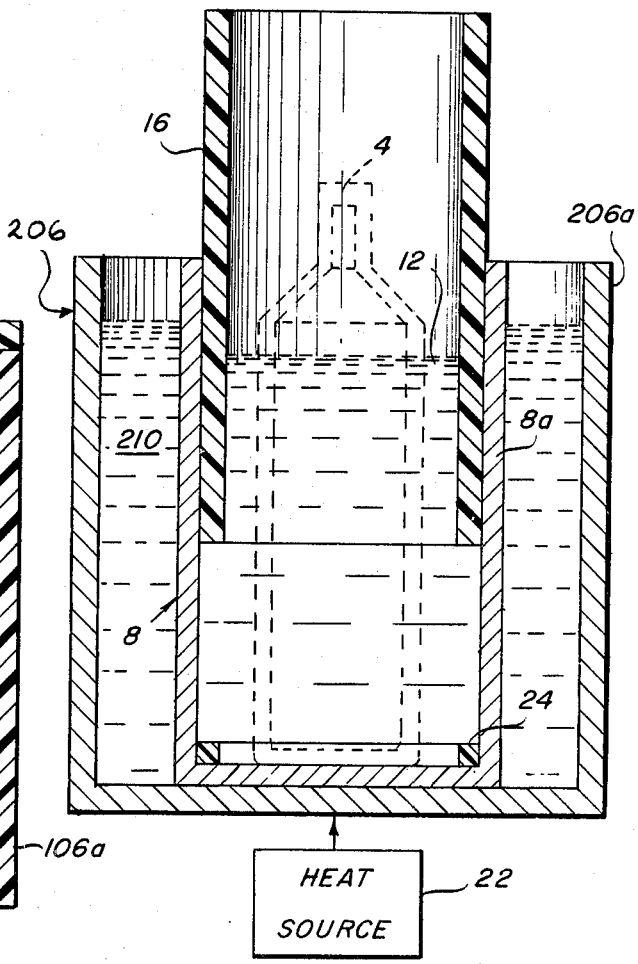

APPARATUS FOR CONTROLLING THE TEMPERATURE OF A BOTTLE

BRIEF DESCRIPTION OF THE PRIOR ART

Cooling devices for bottles and the like are well-known in the patented prior art as evidenced by the patent to Kruger U.S. Pat. No. 905,439. Similarly, devices for maintaining a liquid or a container at a desired temperature are disclosed in the patents to Walker U.S. Pat. No. 2,094,389 and Vogt U.S. Pat. No. 3,203,189. Finally, the patents to White U.S. Pat. No. 3,452,469 and No. 3,654,773 disclose constant temperature bait buckets including manually controlled heat transfer means for varying the rate of heat transfer between an inner container and an outer container, and between the outer container and the outside atmosphere. As disclosed in the White U.S. Pat. No. 3,654,773, the rate of heat transfer from the container to the bait bucket is regulated by manually positioning the container in the bucket to vary the size of the opening between the lower and upper compartments of the bucket.

While the prior devices normally operate quite satisfactorily, they do possess the inherent drawback of not being suitable for adequately and accurately controlling the temperature of an elongated object such as a bottle. Furthermore, many of the prior devices are characterized by a plurality of complex and expensive moving parts which are often unreliable for desired temperature control.

SUMMARY OF THE INVENTION

Accordingly, a primary object of the present invention is to provide an apparatus for controlling the temperature of a bottle or the like including an outer container having a vertically arranged tubular wall portion open at its upper end and having an inner first diameter. An inner container also having a vertically arranged tubular wall portion open at its upper end is formed of heat conducting material and arranged in concentrically spaced relation within the outer container, the outer diameter of the inner container tubular wall portion being less than the first diameter. A first fluid heat transfer medium is arranged in the space between the inner and outer containers, and a heat energy transfer control device is arranged within the inner container. When a bottle is placed within the inner container, the heat energy transfer control device is adjusted to control the transfer of heat energy between the bottle and the first fluid medium through the inner container, thereby to control the temperature of the bottle.

According to a more specific object of the invention, the heat transfer control device includes a generally tubular, hollow, heat-insulating sleeve member having an outer diameter slightly less than the inner diameter of the inner container tubular wall portion. The sleeve member is vertically displaceable within the inner container to vary the operative heat transfer surface area of the inner container in accordance with the desired temperature of the bottle.

It is a further object of the invention to provide a device for cooling a bottle to a desired temperature wherein the outer container is formed of a heat-insulating material and the first fluid medium comprises a coolant having a temperature generally in the range of 32°–40° F.

According to an alternative object of the invention, a device for heating a bottle to a desired temperature is provided, wherein the outer container is formed of heat-conducting material and the first fluid medium comprises a heated fluid having a temperature generally in the range of 200°–212° F.

BRIEF DESCRIPTION OF THE FIGURES

Other objects and advantages of the invention will become apparent from a study of the following specification when viewed in the light of the accompanying drawing, in which:

FIG. 1 is a perspective view of the bottle temperature controlling apparatus;

FIG. 2 is a full sectional view taken along line 2—2 of FIG. 1;

FIG. 3 is a full sectional view of an alternate embodiment of FIG. 2 illustrating the insulating sleeve member; and FIG. 4 is a full sectional view of an alternate embodiment of FIG. 3 illustrating the bottle heating apparatus.

DETAILED DESCRIPTION

Referring first more particularly to FIG. 1, there is shown a bottle temperature controlling device 2 for controlling the temperature of a bottle 4. The device includes an outer container 6 having a vertically arranged tubular wall portion 6*a* open at its upper end and having an inner first diameter $d_1$. An inner container 8 is arranged in concentrically spaced relation within the outer container 6 and also has a vertically arranged tubular wall portion 8*a*. As shown in FIG. 2, the inner diameter $d_2$ of the inner container tubular wall portion is greater than the outer diameter of the bottle whose temperature is to be controlled. Furthermore, the outer diameter $d_3$ of the inner container tubular wall portion is less than the first diameter $d_1$. As will be developed in greater detail below, the inner container 8 is formed of any suitable heat-conducting material, for example, a metal such as aluminum.

The bottle temperature control device 2 further includes a first fluid medium 10 having a given temperature arranged in the space between the inner container 8 and the outer container 6. Furthermore, a heat energy transfer control device is arranged within the inner container 8 for controlling the amount of heat transfer between the bottle 4 and the first fluid medium 10 through the heat-conducting inner container 8, thereby to control the temperature of the bottle.

In the embodiment shown in FIG. 2, the heat energy transfer control device comprises a second fluid medium 12 such as water which surrounds the bottle 4 within the container 8. Since the air surrounding the bottle 4 normally acts as an insulator, raising the level of the second fluid 12 results in a greater amount of heat transfer between the bottle and the first fluid medium. The inner surface of the inner container tubular wall portion 8*a* includes a plurality of graduations 14 corresponding with various depths of the second fluid medium 12. Thus, the desired degree of heat transfer may be accurately gauged by filling the inner container to the desired depth.

In the alternate embodiment of FIG. 3, the heat energy transfer control device further comprises a generally tubular, hollow, heat-insulating sleeve member 16 having an outer diameter $d_4$ slightly less than the inner diameter $d_2$ of the inner container tubular wall portion 8*a*. The sleeve member 16 is formed of any suitable heat-insulating material, such as synthetic plastic or foam material (for example, polystyrene). In this embodiment, the depth of the second fluid medium 12 remains constant at a level just below the upper end of the inner container tubular wall portion, whereby the surface area of the bottle is substantially exposed to the second fluid medium 12. The sleeve member 16 is vertically displaceable within the inner container to vary the surface area of the inner container tubular wall portion 8*a* exposed to the second fluid medium 12, thereby to control the degree of heat transfer between the bottle 4 and the first fluid medium.

In both of the embodiments of FIGS. 2 and 3, the vertical position of the heat energy transfer control device (i.e., the second fluid medium 12 or the sleeve member 16) controls the degree of heat transfer between the first fluid medium and the bottle 4 resulting from the system attaining a natural state of heat equilibrium. Thus, where the second fluid medium 12 or the sleeve member 16 is in its lowermost position, there is little heat transfer and a greater temperature difference between the bottle and the first fluid medium. However, when the second fluid medium 12 or the sleeve member 16 is in its uppermost position, there is high transfer and the temperature of the bottle more closely approximates that of the first fluid medium. The temperature controlling device may be used to either cool or heat a bottle. When used as a cooling device, the outer container 106 is preferably formed of a suitable heat-insulating material, such as polystyrene, and the first fluid medium 110 comprises a coolant such as a mixture of ice and water having a temperature generally equal to the freezing point of water. In this embodiment, heat is transferred from the bottle to the fluid medium to thereby lower the bottle temperature. The ultimate temperature to which the bottle is cooled is directly related to the amount of heat transfer. Thus by accurately positioning the heat transfer control device, the temperature of the bottle can be lowered to and maintained at a desired level. To preserve the coolant, an insulated cover member 18 is arranged over the space between the inner and outer containers. The cover member 18, which may also be formed of polystyrene, contains a central opening 20 for receiving the tubular sleeve 16 and the bottle 4.

When used as a heating device, as shown in FIG. 4, the outer container 206 is formed of a heat-conducting material such as metal, for example, aluminum, and the first fluid medium 210 comprises a heated fluid such as boiling water having a temperature generally equal to the boiling point of water. Thus heat is transferred from the fluid medium 12 to the bottle 4 to thereby raise the bottle temperature. Also shown in FIG. 4 is a heat source 22 which supplies heat to the heat-conducting outer container to maintain the first fluid medium 210 at the boiling point. A generally circular ring 24 of heat-insulating material such as polystyrene is arranged in contiguous relation along the inner container tubular wall portion 8*a* at the bottom of the inner container 8. The ring serves to restrict the area of heat transfer through the surface of the inner container to the side portion thereof. This serves to more evenly distribute the heat being transferred resulting in greater efficiency at maintaining the bottle at a given temperature.

In the aforementioned embodiments of the invention, the inner container 8 is formed of a material having good heat-conducting properties such as a metal, and the outer container 6, 106, 206 is formed of either a heat insulating or heat conducting material depending upon whether the device is to be used to cool or heat a bottle, respectively. It will be apparent to those skilled in the art that the inner container 8 may also be formed from different materials having various heat conducting properties depending upon whether the device is to be used to heat or cool a bottle.

Thus, for example, when it is desired to heat a baby bottle to a temperature of approximately 100° F., using a first fluid medium 210 of boiling water having a temperature generally equal to the boiling point of water, the inner container is formed of a material having only fair heat conducting properties such as a thin synthetic plastics material such as polyethylene. The provision of a synthetic plastic inner container will result in the second fluid medium 12 having a temperature of approximately 125° F. Insertion of the insulating sleeve member 16 will further lower the temperature of the second fluid medium 12 to approximately 100° F.±5° F. depending upon the vertical position of the sleeve.

Alternatively, when it is desired to cool a wine bottle to a temperature of between 40° and 65° F., using a first fluid medium 110 of melting ice and water having a temperature generally equal to the freezing point of water, the inner container is formed of a metallic material having good heat conducting properties. The transfer of heat energy through the inner container will result in the second fluid medium 12 having a temperature of approximately 40° F. Insertion of the insulating sleeve member 16 will further raise the temperature of the second fluid medium 12 up to approximately 65° F. depending upon the vertical position of the sleeve.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. Apparatus for controlling the temperature of a bottle or the like, comprising (a) an outer container having a vertically arranged tubular wall portion open at its upper end, said tubular wall portion having an inner first diameter;

(b) an impermeable inner container having a vertically arranged tubular wall portion open at its upper end, the outer diameter of the inner container tubular wall portion being less than said first diameter, said inner container being formed of heat-conducting material and being arranged in concentrically spaced relation within said outer container, the inner diameter of said inner container tubular wall portion being greater than the outer diameter of the bottle;

(c) a first fluid medium arranged in the space between said inner and outer containers, said first fluid medium having a given initial temperature; and (d) heat energy transfer control means arranged within said inner container, whereby when the bottle is placed in said inner container, said control means controls the transfer of heat energy between the bottle and said first fluid medium through said inner container to control the temperature of the bottle.

2. Apparatus for controlling the temperature of a bottle or the like, comprising (a) an outer container having a vertically arranged tubular wall portion open at its upper end, said tubular wall portion having an inner first diameter;

(b) an impermeable inner container having a vertically arranged tubular wall portion open at its upper end, the outer diameter of the inner container tubular wall portion being less than said first diameter, said inner container being formed of heat-conducting material and being arranged in concentrically spaced relation within said outer container, the inner diameter of said inner container tubular wall portion being greater than the outer diameter of the bottle;

(c) a first fluid medium aranged in the space between said inner and outer containers, said first fluid medium having a given initial temperature; and (d) heat energy transfer control means arranged in contiguous relation within a portion of said inner container, said control means being vertically displaceable between lower low heat transfer and upper high heat transfer positions to vary the operative heat transfer surface area of said inner container, whereby when the bottle is placed in said inner container, said control means controls the transfer of heat energy between the bottle and said first fluid medium through said inner container to control the temperature of the bottle.

3. Apparatus as defined in claim 2, wherein said control means comprises a second fluid.

4. Apparatus as defined in claim 3, wherein said control means further comprises a generally tubular hollow heat-insulating sleeve member having an outer diameter slightly less that the inner diameter of said inner container tubular wall portion, said sleeve member being vertically displaceable, said second fluid having a constant depth slightly less than the height of said inner container.

5. Apparatus as defined in claim 4, wherein said outer container is formed from a heat-conducting material.

6. Apparatus as defined in claim 5, wherein said first fluid medium comprises a heated fluid, said given temperature being generally in the range of 200°–212° F., whereby the apparatus is used to heat the bottle to a predetermined temperature.

7. Apparatus as defined in claim 4, wherein said outer container is formed from a heat-insulating material.

8. Apparatus as defined in claim 7, wherein said first fluid medium comprises a coolant, said given temperature being generally in the range of 32°–40° F., whereby the apparatus is used to cool the bottle to a predetermined temperature.

9. Apparatus as defined in claim 8, and further including a heat-insulating cover member for covering the space between said inner and outer containers, said cover member including a centrally arranged aperture for receiving said sleeve member and the bottle.

* * * * *